US009035788B2

(12) United States Patent
Downton et al.

(10) Patent No.: US 9,035,788 B2
(45) Date of Patent: May 19, 2015

(54) REAL TIME TELEMETRY

(75) Inventors: Geoff Downton, Minchinhampton (GB); Luke Kuwertz, Oklahoma City, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1290 days.

(21) Appl. No.: 11/865,942

(22) Filed: Oct. 2, 2007

(65) Prior Publication Data

US 2009/0086576 A1 Apr. 2, 2009

(51) Int. Cl.
*G01V 3/00* (2006.01)
*E21B 47/18* (2012.01)

(52) U.S. Cl.
CPC ..... *E21B 47/182* (2013.01)

(58) Field of Classification Search
CPC ..... E21B 47/182
USPC ..... 340/853.1, 853.3, 853.4; 367/81, 83, 84
See application file for complete search history.

(56) References Cited

U.S. PATENT DOCUMENTS

| | | | | |
|---|---|---|---|---|
| 5,332,048 | A * | 7/1994 | Underwood et al. | 175/26 |
| 6,089,332 | A * | 7/2000 | Barr et al. | 175/45 |
| 6,400,646 | B1 * | 6/2002 | Shah et al. | 367/82 |
| 6,424,595 | B1 * | 7/2002 | Chenin | 367/82 |
| 6,714,138 | B1 * | 3/2004 | Turner et al. | 340/854.3 |
| 2003/0026167 | A1 * | 2/2003 | Hahn et al. | 367/38 |
| 2003/0218940 | A1 * | 11/2003 | Jogi et al. | 367/82 |
| 2005/0001737 | A1 * | 1/2005 | Baron et al. | 340/854.4 |
| 2005/0052949 | A1 * | 3/2005 | Gaston et al. | 367/57 |
| 2006/0118304 | A1 * | 6/2006 | Ohmer | 166/301 |
| 2006/0155474 | A1 * | 7/2006 | Venkataramanan et al. | 702/13 |
| 2006/0185900 | A1 * | 8/2006 | Jones et al. | 175/26 |
| 2007/0153628 | A1 * | 7/2007 | Mathiszik et al. | 367/57 |
| 2008/0000688 | A1 * | 1/2008 | McLoughlin et al. | 175/40 |
| 2008/0024319 | A1 * | 1/2008 | Close | 340/854.3 |

* cited by examiner

*Primary Examiner* — Amine Benlagsir
(74) *Attorney, Agent, or Firm* — Chadwick A. Sullivan; Wesley Noah

(57) ABSTRACT

A real time telemetry system is disclosed for use with a drilling system including a rotary valve 28 controlling the supply of drilling fluid or mud to a downhole tool. The system comprises receiving data to be transmitted, encoding the data as a duration, and controlling the rotation the rotary valve 28 such that the rotary valve 28 is rotated for the said duration at a predetermined rotary speed to cause the formation of pressure fluctuations or waves in the drilling fluid or mud.

7 Claims, 2 Drawing Sheets

| Inclination | Units | Time (seconds) |
|---|---|---|
| 0 to 1 degrees | 1 | 10 |
| 1 to 2 degrees | 2 | 20 |
| 2 to 3 degrees | 3 | 30 |
| 4 to 5 degrees | 4 | 40 |
| 5 to 6 degrees | 5 | 50 |
| +6 degrees | 6 | 60 |

*FIG. 3A*

Toolface (degrees)

| | 1 | 2 | 3 | 4 | 5 | 6 | 7 | 8 | 9 |
|---|---|---|---|---|---|---|---|---|---|
| 1 | 0 | 18 | 53 | 108 | 180 | 270 | 20 | 160 | 321 |
| 2 | 37 | 72 | 127 | 198 | 288 | 39 | 180 | 340 | 158 |
| 3 | 90 | 143 | 217 | 307 | 61 | 200 | 0 | 180 | 338 |
| 4 | 162 | 233 | 323 | 80 | 219 | 23 | 203 | 0 | 135 |
| 5 | 252 | 342 | 100 | 241 | 45 | 225 | 23 | 158 | 270 |
| 6 | 0 | 120 | 260 | 68 | 248 | 45 | 180 | 293 | 37 |
| 7 | 141 | 280 | 90 | 270 | 68 | 203 | 315 | 72 | 180 |
| 8 | 300 | 113 | 293 | 90 | 225 | 338 | 108 | 218 | 290 |
| 9 | 135 | 315 | 113 | 248 | 0 | 143 | 255 | 326 | 0 |

Deviation (percentage)

| | 1 | 2 | 3 | 4 | 5 | 6 | 7 | 8 | 9 |
|---|---|---|---|---|---|---|---|---|---|
| 1 | 100 | 100 | 100 | 100 | 100 | 100 | 80 | 80 | 80 |
| 2 | 100 | 100 | 100 | 100 | 100 | 80 | 80 | 80 | 60 |
| 3 | 100 | 100 | 100 | 100 | 80 | 80 | 60 | 60 | 60 |
| 4 | 100 | 100 | 100 | 80 | 80 | 60 | 60 | 40 | 40 |
| 5 | 100 | 100 | 80 | 80 | 60 | 60 | 40 | 40 | 40 |
| 6 | 80 | 80 | 80 | 60 | 60 | 40 | 40 | 40 | 20 |
| 7 | 80 | 80 | 60 | 60 | 40 | 40 | 40 | 20 | 20 |
| 8 | 80 | 60 | 60 | 40 | 40 | 40 | 20 | 20 | 20 |
| 9 | 60 | 60 | 40 | 40 | 20 | 20 | 20 | 20 | 0 |

*FIG. 3B*

REAL TIME TELEMETRY

BACKGROUND OF INVENTION

1. Field of the Invention

This invention relates to a telemetry system and in particular to a telemetry system suitable for use in the transmission of data in a borehole.

2. Description of the Related Art

It is desirable, in the drilling of a subterranean borehole in a formation, to be able to transmit data along the borehole. For example, where a steerable drilling system is being used and downhole sensors are provided and arranged to output signals representative of, for example, the drilling direction, it is desirable to be able to transmit signal data representative of the drilling direction, in real time, to an operator located at the surface.

A number of telemetry systems are known which are capable of providing such transmission of data. However, such systems tend to be relatively complex and expensive, and may not be able to transmit data in real time. There are situations where the amount of data to be transmitted is relatively small and the provision of such a telemetry system cannot be justified or, if provided, is not used to its fullest extent. It is an object of the invention to provide a telemetry system of relatively simple and convenient form, suitable for use in such applications.

SUMMARY OF THE INVENTION

According to the present invention there is provided a telemetry system for use in a drilling system including a rotary valve controlling the supply of drilling fluid or mud to a downhole tool, the system comprising receiving data to be transmitted, encoding the data as a duration, and controlling the rotation the rotary valve such that the rotary valve is rotated for the said duration at a predetermined rotary speed to cause the formation of pressure fluctuations or waves in the drilling fluid or mud.

It has been found that the rotation of a rotary valve produces pressure fluctuations or waves in the drilling fluid or mud supplied to, and through, the rotary valve, in use, and that these fluctuations or waves can be sensed, for example, at the surface. By appropriate control of the rotary valve, these pressure fluctuations or waves can be used to transmit signals, without requiring the provision of additional, complex downhole tools. Consequently, data can be transmitted in real time to an operator located at the surface.

Conveniently, the drilling system includes at least one downhole sensor, the output of which comprises the data to be transmitted.

In order to increase the amount of data that can be transmitted using the system, two or more predetermined rotary speeds may be chosen, each being indicative of the output of a respective sensor. Alternatively, the data may be encoded using a look-up table, a first signal transmitted by rotating the valve for a first duration at a first predetermined rotary speed being used to transmit information relating to one coordinate of the look-up table, a second signal transmitted by rotating the valve for a second duration at a second predetermined speed being used to transmit information relating to another coordinate of the look-up table.

The signal transmitted using the system may be decoded by the operator simply by monitoring for how long the pressure fluctuations or waves at the predetermined frequency are received. This may be achieved manually or automatically using an appropriated controlled device.

The signals transmitted in this fashion are most readily identifiable when the drill pipe is stationary. Conveniently, therefore, the system is used to transmit data shortly after the downhole tool has completed its start-up sequence when the pumps supplying the drilling fluid or mud are switched on. However, it may be possible to use the system to transmit data to the surface at other times.

BRIEF DESCRIPTION OF DRAWINGS

The invention will further be described, by way of example, with reference to the accompanying drawings, in which:

FIGS. 3*a* and 3*b* are tables illustrating two possible encoding techniques.

DETAILED DESCRIPTION OF THE INVENTION

Figure 1:
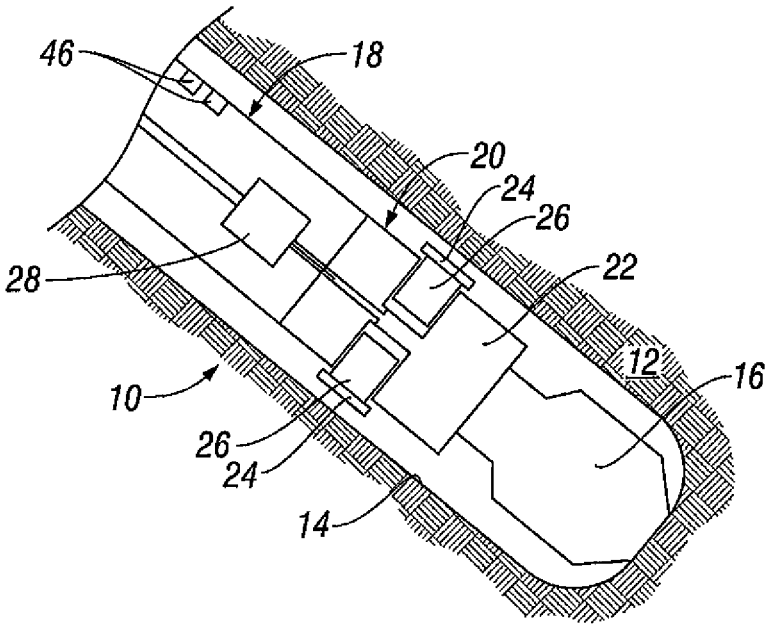
FIG. 1 is a diagrammatic view illustrating part of a bottom hole assembly including a downhole tool controlled using a rotary valve.

Referring firstly to FIG. 1, illustrated diagrammatically is part of a bottom hole assembly 10 for use in the formation of a borehole 14 in a subsurface formation 12. The assembly 10 comprises a drill bit 16 carried by a bias unit 20. A control unit 18 is operable to control the operation of the bias unit 20.

The bias unit 20 includes a housing 22 arranged to carry a series of bias pads 24. Each bias pad 24 is able to move between a retracted position and an extended position, piston arrangements 26 being provided to drive each pad 24 from its retracted position to its extended position. The piston arrangements 26 are operable independently of one another, the supply of fluid under pressure to the piston arrangements 26 being controlled by a rotary control valve 28 located within the control unit 18.

In use, the housing 22 is carried by or forms part of a drill pipe or string which is rotated, for example from the surface or by a downhole located motor. If the piston arrangements 26 are supplied with fluid under pressure in turn, in synchronism with the rotation of the housing 22, it will be appreciated that the bias pads 24 are moved, in turn, to their extended positions. In their extended positions, the pads 24 bear against the wall of the borehole 14 and a laterally directed reaction force is applied to the housing 22. By controlling the piston arrangements 26 in a manner synchronised with the rotation of the housing 22, it will be appreciated that the reaction force acts in a substantially consistent direction. As the drill bit 16 is secured to the housing 22, it will be appreciated that the operation of the bias unit in this manner also results in the application of a laterally directed force to the drill bit 16, thus urging the drill bit to form a curve or dogleg in the borehole 14.

Figure 2:
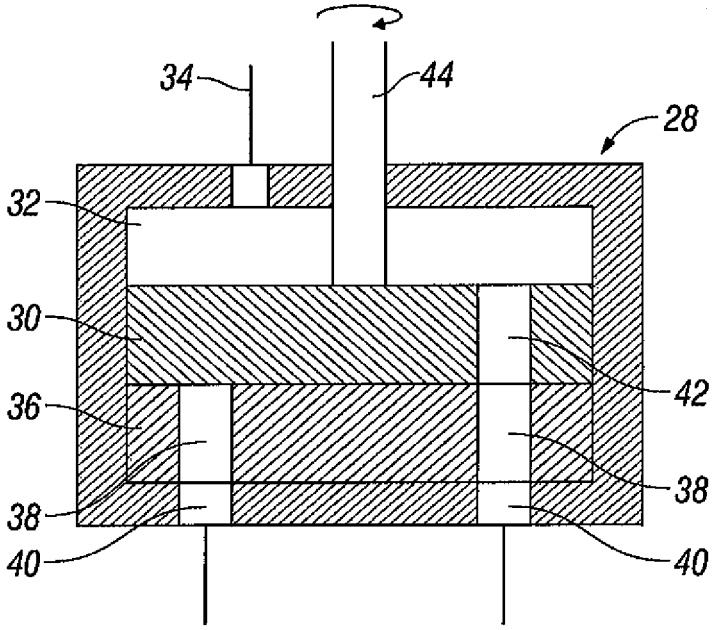
FIG. 2 is a diagrammatic view illustrating the rotary valve.

The rotary control valve 28 comprises a face sealing valve of the type illustrated) diagrammatically, in FIG. 2. The valve comprises a rotary valve member 30 of disc-like form located within a chamber 32 to which drilling fluid or mud is supplied, in use, under pressure through the drill pipe through an inlet 34. Also located within the chamber 32 is an outlet member 36, also of disc-like form, a surface of the valve member 30 abutting a surface of the outlet member 36. The outlet member 36 is formed with a series of openings 38 extending from the surface against which the valve member 30 bears to the opposing surface thereof, each opening communicating with a respective outlet 40. The outlets 40 communicate, in use, with respective ones of the piston arrangements 26. The openings 38 provided in the outlet member 36 are located at a common radial position.

The valve member 30 is provided with an arcuate opening 42 which extends from the surface thereof which abuts the outlet member 36 to the opposing surface thereof and which is provided at the same radial position as the openings 38.

A control shaft 44 extends into the chamber 32 and is connected to the valve member 30 to drive the valve member 30 for rotation.

It will be appreciated that in use, fluid entering the chamber 32 passes through the arcuate opening 42 and into whichever of the openings 38 is aligned therewith, the fluid flowing through the respective outlet 40 to the associated piston arrangement 26. The selection of which, if any, of the outlets 40 to which fluid is supplied by the valve 28 depends upon the angular position of the valve member 30 which, in turn, is dependent upon the angular position of the control shaft 44.

The control shaft 44 may be rotated by a range of devices. For example, an appropriately controlled electrically operated motor may be used to drive the shaft 44 and thereby control the operation of the valve 28. Alternatively, the control shaft 44 could be connected to an appropriately controlled roll stabilised platform. In either case, the movement of the shaft 44 may be controlled in response to the output signals from one or more downhole sensors 46, for example arranged to sense the inclination of the housing 22.

Systems of this type are well known and so the operation thereof will not be described in further detail.

Whilst the control shaft 44 is rotated, pressure fluctuations or waves are formed in the drilling fluid or mud in the drill pipe as communication commences, and subsequently is broken, between the arcuate opening 42 and the openings 38, in turn. The pressure fluctuations or waves so formed can be sensed at the surface or at other locations spaced from the valve 28, especially at times when the drill pipe is not being rotated.

In accordance with the invention, the formation of these pressure fluctuations or waves is harnessed to enable the transmission of data from the bottom hole assembly, for example to the surface. For example, where the sensor 46 is arranged to output a signal representative of the inclination of the bias unit housing 22, the output signal from the sensor 46 is encoded, for example using the table shown in FIG. 3*a* to derive a duration representative of the sensed inclination. The rotary valve 28 is then driven for rotation at a predetermined rotary speed for the derived duration, thus transmitting a series of pressure fluctuations or waves through the drilling fluid or mud at a frequency related to the speed of rotation of the rotary valve for the derived duration. Surface located equipment sensitive to the pressure fluctuations or waves in the fluid can be used to enable an operator to measure for how long the pressure fluctuations or waves were transmitted at the predetermined frequency. The duration can then be decoded to provide the operator with real time information representative of the inclination of the housing 22.

For example, if the sensor 46 output indicates that the housing 22 is inclined at an angle of 2.5 degrees, using the technique described hereinbefore with reference to FIG. 3*a*, the rotary valve 28 is rotated for a period of 30 seconds at the predetermined rotary speed, for example at a speed causing pressure fluctuations or waves to be transmitted at a frequency of 6 Hz. The operator, upon measuring that a 6 Hz signal has been received for 30 seconds can ascertain, in real time, that the inclination of the housing 22 is in the range 2-3 degrees. It will be appreciated that other rotary speeds of the valve 28 may be used to transmit signals, and that the durations and ranges of inclination angles, and relationships therebetween, may be selected to suit the application in which the invention is used.

Where two or more sensors are provided, data representative of the outputs of the sensors may be transmitted, in turn, for example with the rotary valve being rotated at different rotary speeds so as to provide an indication of for which parameter data is being transmitted.

FIG. 3*b* illustrates an alternative encoding technique which may be used to transmit larger quantities of data using the system of the invention. In this arrangement, the output signals from the sensors are encoded using a look-up table. For example, if it is determined that the toolface angle is 90 degrees and the deviation is 60%, then using the look-up table shown in FIG. 3*b* it can be seen that this combination of parameter values occurs in column 3, row 7 of the look-up table. In this example, the column data is transmitted by rotating the valve 28 at a rotary speed to generate pressure fluctuations or waves at a frequency of 4 Hz, and row data is transmitted by rotating the valve 28 to cause pressure fluctuations or waves at a frequency of 6 Hz. Thus, in order to transmit the data, the valve is rotated to cause a 4 Hz signal to be transmitted for 3 units of time, for example 30 seconds, the valve subsequently being rotated to transmit a 6 Hz signal for 7 units of time, for example 70 seconds. Upon receiving these signals, the operator can decode the signals using the same look-up table to obtain, in real time, the toolface and deviation data.

If desired, the look-up table could be used to transmit tool status codes or words to the operator.

As mentioned hereinbefore, this information is best transmitted when the drill string is not being rotated, and may conveniently be transmitted shortly after the downhole tool has completed its startup procedure when the drilling fluid pumps are activated after recycling. However, it may be possible to successfully transmit and receive data using the system at other times.

The signal received at the surface may be measured simply by the operator determining for how long a signal at a predetermined frequency has been transmitted, which he then decodes. Alternatively, surface located equipment may be used to sense the transmission of signals at the predetermined frequency or frequencies, to measure for how long the signals are transmitted, to decode the signals and to produce an appropriate output for the operator.

The ability to transmit data in real time in accordance with the invention is advantageous in that, compared to conventional arrangements, data can be transmitted in a relatively simple, quick and convenient manner. Data can thus be transmitted more frequently and cost effectively than is possible with conventional arrangements. The real time transmission of data also enables an operator to ascertain that the downhole equipment is operating correctly, that communications links with the downhole equipment are functioning, and may allow greater control over the downhole equipment as, for example, deviations from a desired path may be sensed and corrected more quickly. The system does not require the provision of additional downhole tools or equipment, but rather may be implemented simply by appropriate modification of the control system of a standard downhole tool.

It will be appreciated that a range of modifications and alterations may be made to the invention described hereinbefore without departing from the scope of the invention.

The invention claimed is:

1. A telemetry system for use in a drilling system comprising:

a rotary valve controlling a supply of drilling fluid or mud to a downhole tool, wherein the rotary valve having a rotary valve member located within a chamber and an outlet member;

a control shaft extends into the chamber and is connected to the rotary valve member to drive a rotation of the rotary valve member;

the rotary valve member including an opening which selectively communicates with a series of openings in the outlet member to enable control over a flow of the drilling fluid or the mud to the downhole tool, wherein a selection of which opening of the series of openings of the outlet member, the drilling fluid or the mud is supplied to by the rotary valve depends upon an angular position of the rotary valve member, which, in turn the rotary valve member is dependent upon an angular position of the control shaft;

Whilst the control shaft is rotated, pressure fluctuations or waves are formed in the drilling fluid or the mud in a drill pipe as communication commences, and subsequently is broken, wherein the pressure fluctuations or the waves are sensed at locations spaced from the rotary valve, especially at times when the drill pipe is not being rotated;

the telemetry system for use in the drilling system also comprising receiving data to be transmitted, encoding the data as a duration, and controlling a rotation of the rotary valve such that the rotary valve member of the rotary valve is rotated with respect to the outlet member for the duration at a predetermined rotary speed to cause a formation of the pressure fluctuations or the waves in the drilling fluid or the mud to create telemetry signals at a frequency related to a speed of the rotation of the rotary valve for the duration, wherein the duration is decoded to provide an operator with real time information.

2. The telemetry system for use in the drilling system according to claim 1, further comprises at least one downhole sensor, an output of the at least one downhole sensor comprises the data to be transmitted.

3. The telemetry system for use in the drilling system according to claim 2, further comprises a plurality of sensors, and wherein the rotary valve is rotated at two or more predetermined rotary speeds, each predetermined rotary speed of the two or more predetermined rotary speeds being indicative of an output of a respective sensor of the plurality of sensors.

4. The telemetry system for use in the drilling system according to claim 1, wherein a first signal transmitted by rotating the rotary valve for a first duration at a first predetermined rotary speed is used to transmit information relating to one coordinate of a look-up table, a second signal transmitted by rotating the rotary valve for a second duration at a second predetermined speed being used to transmit information relating to another coordinate of the look-up table.

5. The telemetry system for use in the drilling system according to claim 1, wherein the data is encoded using a look-up table.

6. The telemetry system for use in the drilling system according to claim 5, wherein the data is transmitted shortly after the downhole tool has completed its start-up sequence when pumps supplying the drilling fluid or the mud are switched on.

7. The telemetry system for use in the drilling system according to claim 1, wherein the downhole tool comprises a bias unit.

* * * * *